US008590989B2

(12) United States Patent
Lowe

(10) Patent No.: US 8,590,989 B2
(45) Date of Patent: Nov. 26, 2013

(54) SOFT CLOSE MECHANISM IN A DRAWER SLIDE ASSEMBLY

(75) Inventor: Mark Jeffrey Lowe, Bossier City, LA (US)

(73) Assignee: Hardware Resources, Inc., Bossier City, LA (US)

( * ) Notice: Subject to any disclaimer, the term of this patent is extended or adjusted under 35 U.S.C. 154(b) by 210 days.

(21) Appl. No.: 13/136,376

(22) Filed: Jul. 29, 2011

(65) Prior Publication Data

US 2013/0028544 A1 Jan. 31, 2013

(51) Int. Cl.
*A47B 88/04* (2006.01)

(52) U.S. Cl.
USPC ..... 312/319.1; 312/333

(58) Field of Classification Search
USPC ..... 312/330.1, 333, 319.1, 334.1, 334.7, 312/334.8, 334.11, 334.44, 334.47; 384/21, 384/22
See application file for complete search history.

(56) References Cited

U.S. PATENT DOCUMENTS

| | | | | |
|---|---|---|---|---|
| 6,736,471 | B2 | 5/2004 | Lin | |
| 6,953,233 | B2 | 10/2005 | Lam et al. | |
| 7,028,370 | B2 | 4/2006 | Hoshide et al. | |
| 7,244,005 | B1 * | 7/2007 | Lu | 312/333 |
| 7,465,000 | B2 | 12/2008 | Huang | |
| 7,815,267 | B1 | 10/2010 | Frousiakis | |
| 8,083,304 | B2 * | 12/2011 | Hu | 312/333 |
| 8,118,378 | B2 * | 2/2012 | Wei et al. | 312/333 |
| 8,308,251 | B2 * | 11/2012 | Liang et al. | 312/333 |
| 8,459,758 | B2 * | 6/2013 | Rechberg et al. | 312/333 |
| 2004/0227438 | A1 | 11/2004 | Tseng et al. | |
| 2008/0136300 | A1 * | 6/2008 | Wang | 312/319.1 |
| 2008/0169741 | A1 * | 7/2008 | Jurja | 312/319.1 |
| 2009/0033187 | A1 * | 2/2009 | Chung | 312/319.1 |
| 2009/0140621 | A1 * | 6/2009 | Yang | 312/319.1 |
| 2010/0026152 | A1 * | 2/2010 | Huang | 312/319.1 |

* cited by examiner

*Primary Examiner* — James O Hansen
(74) *Attorney, Agent, or Firm* — Schultz & Associates, P.C.

(57) ABSTRACT

A linear bearing drawer slide assembly comprised of a spring damper mechanism attached to a fixed member slidingly engaged with a middle member slidingly engaged with a drawer member. The spring damper mechanism is comprised of a base connected to a guide track which includes a longitudinal channel and a pair of opposing catches. A carriage slidingly engages the guide track. A pivotal latch pivots on a column of the carriage and further includes a pair of posts that extend through the carriage to engage the pair of catches in the guide track. The base and the carriage secure a pair of springs providing a balanced closing force against a damper which reduces unwanted wear and prolongs the useable life of the drawer slide assembly.

5 Claims, 7 Drawing Sheets

SOFT CLOSE MECHANISM IN A DRAWER SLIDE ASSEMBLY

FIELD OF THE INVENTION

The present invention relates to sliding bearing assemblies for mounting drawers in cabinetry. In particular, the invention relates to linear drawer slides with spring damper mechanisms for controlled drawer closure.

BACKGROUND OF THE INVENTION

Uncontrolled closure of a drawer can result in the problems of unwanted noise and premature wear of drawer slides, drawers and cabinetry. The art has responded generally to these problems by providing controlled closure mechanisms attached to the drawer slides. The controlled closure mechanisms often include a spring damper mechanism which cushions drawer closure, thereby reducing wear and noise. However, the controlled closure mechanisms of the prior art are cumbersome and prone to failure.

For example, U.S. Patent Application Publication No. 2004/0227438 to Tseng, et al. discloses an automatic return guiding device including a first track member having a base slidingly engaging a second track member. The base includes a sliding seat having a slot. A truck is mounted on the sliding seat and includes two pegs in the slot. A single spring is attached between the front peg of the sliding member and a rear end of the base. The truck includes an inclined face and a recessed portion. The inclined face and the recessed portion form a resilient plate on a body of the truck. A force provided by the spring produces a moment about the sliding seat. The moment is offset by the sliding seat. However, this arrangement creates premature wear on the sliding seat and other components of the device and the track members resulting in premature failure.

U.S. Pat. No. 6,736,471 to Lin discloses a buffer and return device for a slide rail in a drawer. The return device is attached to an outer rail of the drawer and includes a base, a buffer plunger and an elastic element. The base has a base chamber at a front section. The base chamber has an air passage and a lateral passage. The elastic element has one end fixed to a front end of the base chamber. A retaining plate is provided that includes a locking element moveable between a locked and an unlocked position. The retaining plate is connected to the buffer plunger and the elastic element with a lower projection passing through the bottom slot. As the drawer is closed, the buffer plunger discharges air in the base chamber to slowly close the drawer. The air passage is complicated. Further, the single elastic element produces a moment about the retaining plate which produces premature wear on the components of the device and the rails.

U.S. Pat. No. 6,953,233 to Lam, et al. discloses a cylindrical housing having two axial slots. A truck is slidable in the body with the projection extending into the second slot. The truck receives a pin attached to a guide rail of the drawer. When the drawer is opened, the pin pulls the truck along the first slot. The truck rotates and locks in the second slot. When the drawer is closed, the pin engages the first slot and rotates the truck, thus releasing the slidable body. A single spring pulls the drawer to a closed position. The single spring creates a moment which creates unnecessary wear on the components of the device and the guide rails.

U.S. Pat. No. 7,028,370 to Hoshide, et al. discloses a drawer retracting apparatus. A guiding member having two L-shaped guiding grooves is attached to a fixed portion of a cabinet member. A generally rectangular plate shaped engagement member is slidingly engaged with the guiding member by two pins in the two L-shaped guiding grooves and further connected to the guiding member by a single coil spring. A driving member attached to the moving drawer releasably engages the engaging member and the coil spring pulls the drawer member to a closed position. When opening the drawer, the engagement member slides along the guiding member until the two pins move through a generally vertically oriented section of the two guiding grooves thus releasing the driving member from engagement with the engagement member. The engagement member is locked into place until the drawer is returned. The coil spring creates an unbalanced moment force on the rectangular plate. The unbalanced force creates unnecessary wear on the engagement member and the grooves of the guiding member.

There is a need for a less expensive, less complicated, and easily installed alternative to prior art drawer slides with controlled closing mechanisms. The controlled closing mechanism disclosed provides an inexpensive yet durable and novel design which prevents unnecessary wear on drawer slides and the mechanism itself, thereby prolonging the life of components and reducing the frequency of replacement.

SUMMARY OF INVENTION

One preferred embodiment provides a full extension "soft close" mechanism which prolongs the usable life of the drawer slide assembly and cabinetry. The preferred embodiment provides various elements of the mechanism to eliminate longitudinally induced moment forces on the components which increases dependability and reduces wear. The preferred embodiment also provides a reduced number of components, thereby reducing cost and further increasing dependability. The preferred embodiment is an inexpensive alternative to prior art spring damper closure mechanisms.

Accordingly, an embodiment of the apparatus is positioned on a drawer slide assembly comprised of a nested set of slide members. A fixed slide member in a set of cabinetry supports a first set of linear bearings. The first set of linear bearings supports a central slide member. The central slide member supports a second set of linear bearings. The second set of linear bearings supports a drawer member. A soft close mechanism is attached to the fixed member and releasably engages the drawer through a pin on the drawer member.

The assembly is comprised of a base connected to a guide track which includes a longitudinal channel and a pair of opposing catches. A carriage slidingly engages the guide track. A pivotal latch is mounted on a column of the carriage and includes a catch, an internal deflector spring, and a pair of posts. The posts extend from the carriage and engage the pair of catches in the guide track. A pair of coil springs is connected between the base and the carriage. The springs are laterally equidistant from a damper which is centrally housed in the base and from the guide track. A piston rod of the damper extends through the base, along the channel, and is secured in the carriage.

During the closing sequence, a projection on the drawer member deflects the deflector spring and releasably engages a pivotal latch. The latch rotates and secures the projection. Upon rotation of the pivotal latch, the carriage slides on the guide track toward the base. The pair of springs provides a balanced force on the carriage and pulls the drawer closed while the damper controls the rate of speed at which the drawer closes.

During the opening sequence, the drawer member, engages with the pivotal latch and pulls the carriage along the guide track away from the base. The posts of the pivotal latch engage the catches on the guide track and rotate the pivotal latch, thus disengaging the drawer member. The location of the pair of springs reduces the force required to dislodge the pivotal latch, thereby reducing the inherent noise and vibration of the system and increasing its ease of operation.

Those skilled in the art will appreciate the above-mentioned features and advantages of the invention together with other important aspects thereof upon reading the detailed description that follows in conjunction with the drawings provided.

BRIEF DESCRIPTION OF THE DRAWINGS

In the detailed description of the preferred embodiments presented below, reference is made to the accompanying drawings.

DETAILED DESCRIPTION OF THE PREFERRED EMBODIMENT

Figure 1:
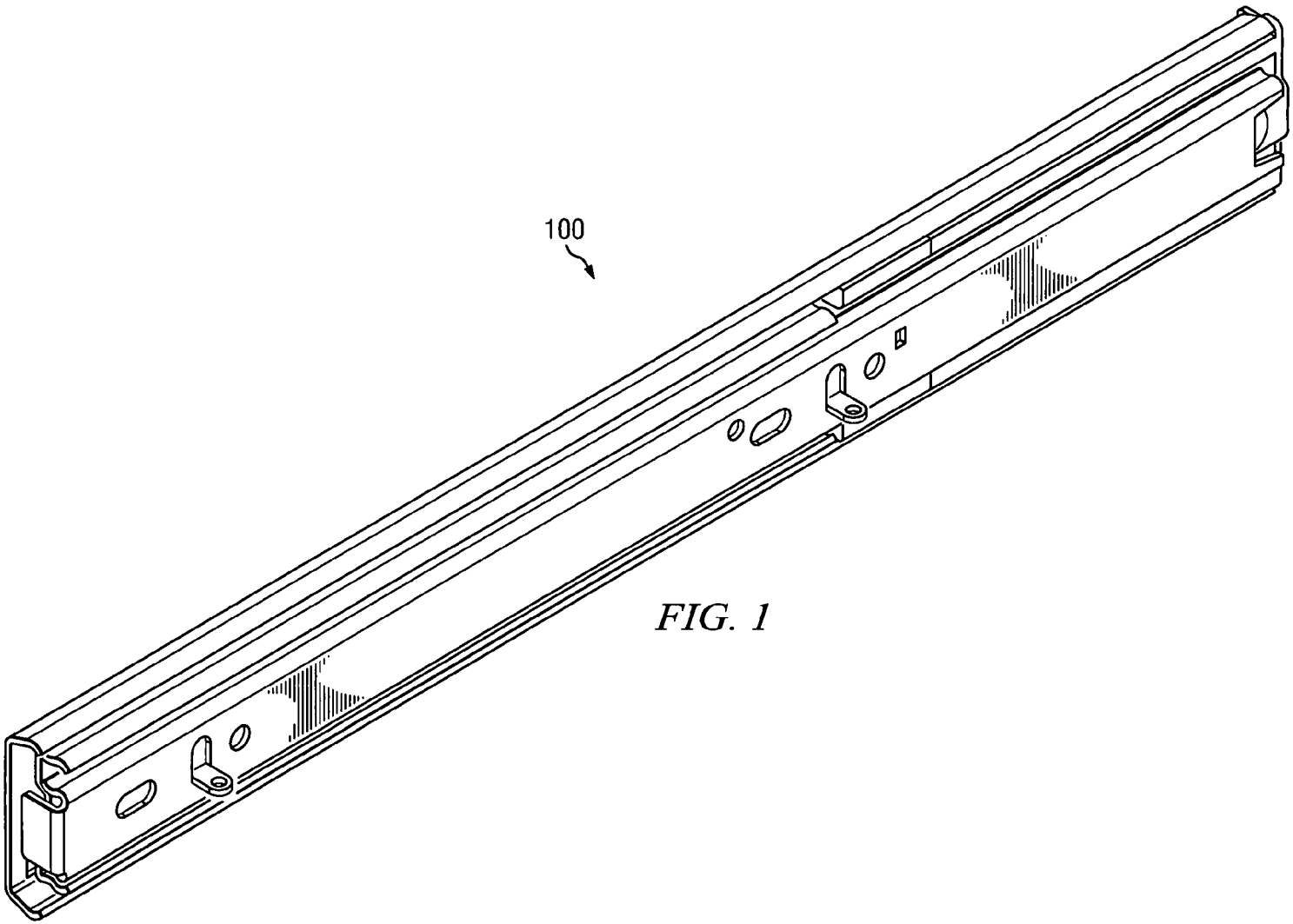
FIG. 1 is an isometric view of a preferred embodiment of the drawer slide assembly.

In the descriptions that follow, like parts are marked throughout the specification and drawings with the same numerals, respectively. The drawing figures are not necessarily drawn to scale and certain figures may be shown in exaggerated or generalized form in the interest of clarity and conciseness.

Figure 2:
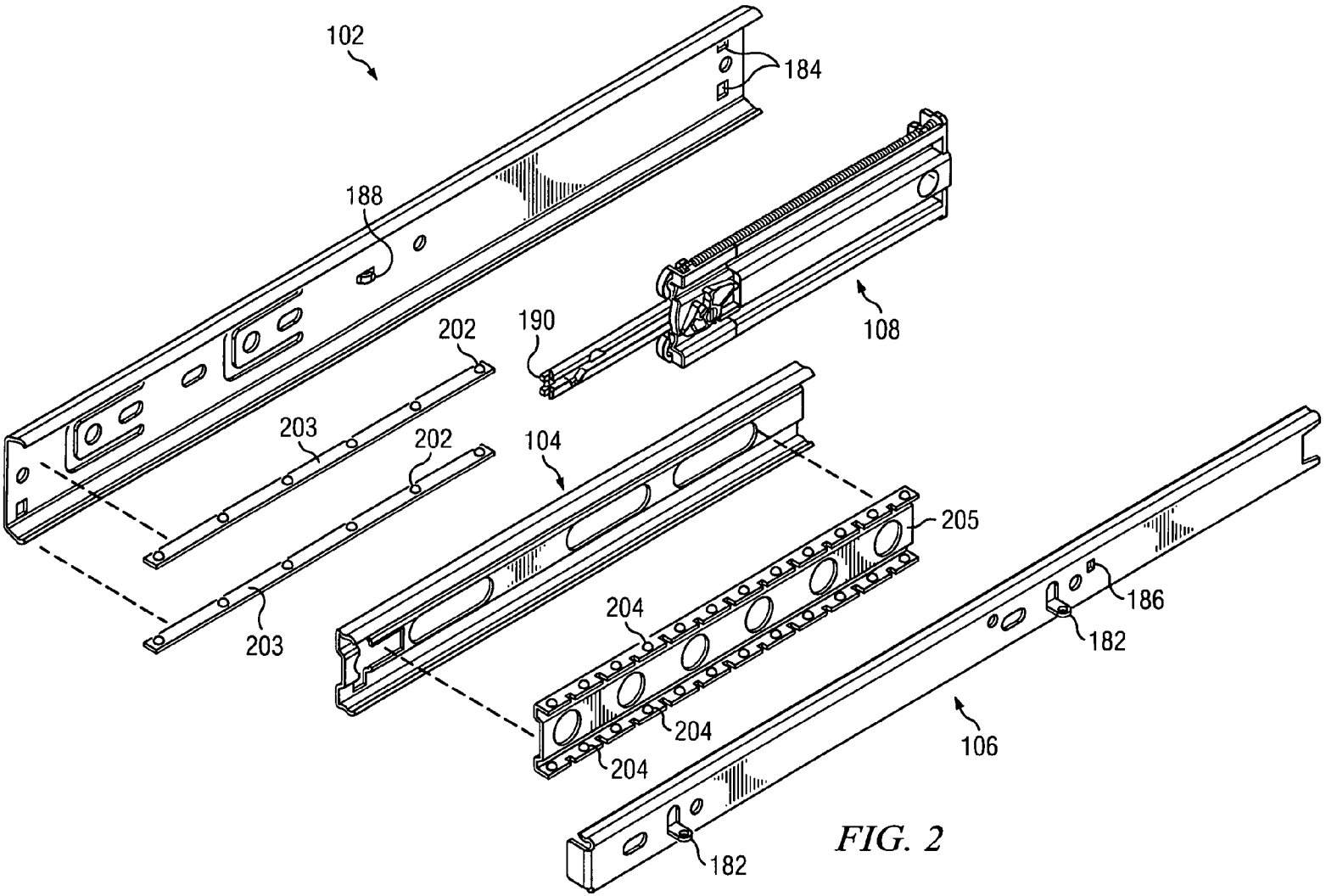
FIG. 2 is an exploded isometric view of a preferred embodiment of the drawer slide assembly.
Figure 5A:
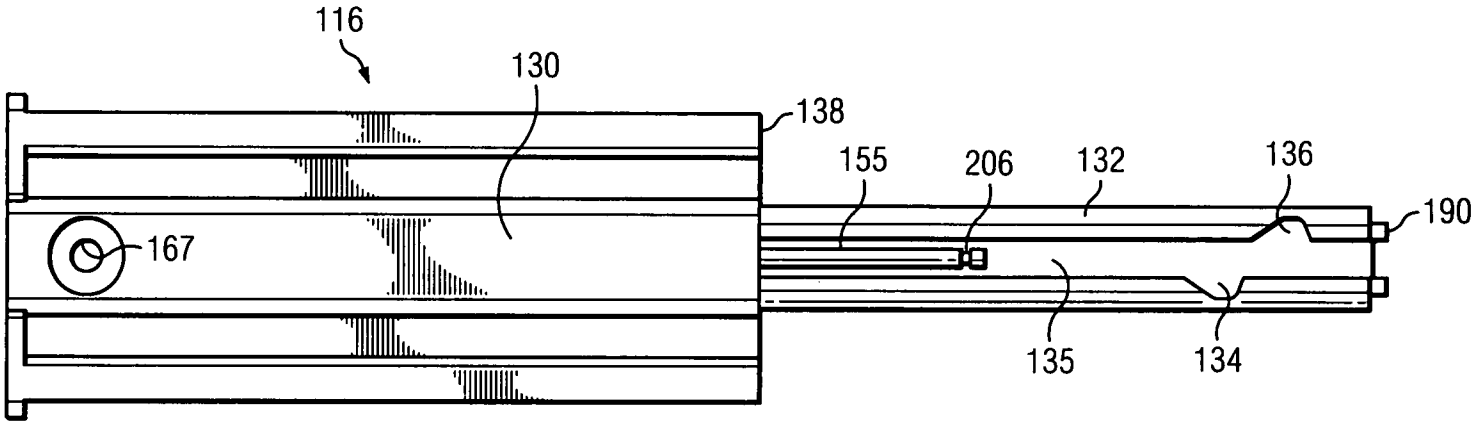
FIG. 5A is a plan view of a preferred embodiment of the fixture.
Figure 5B:
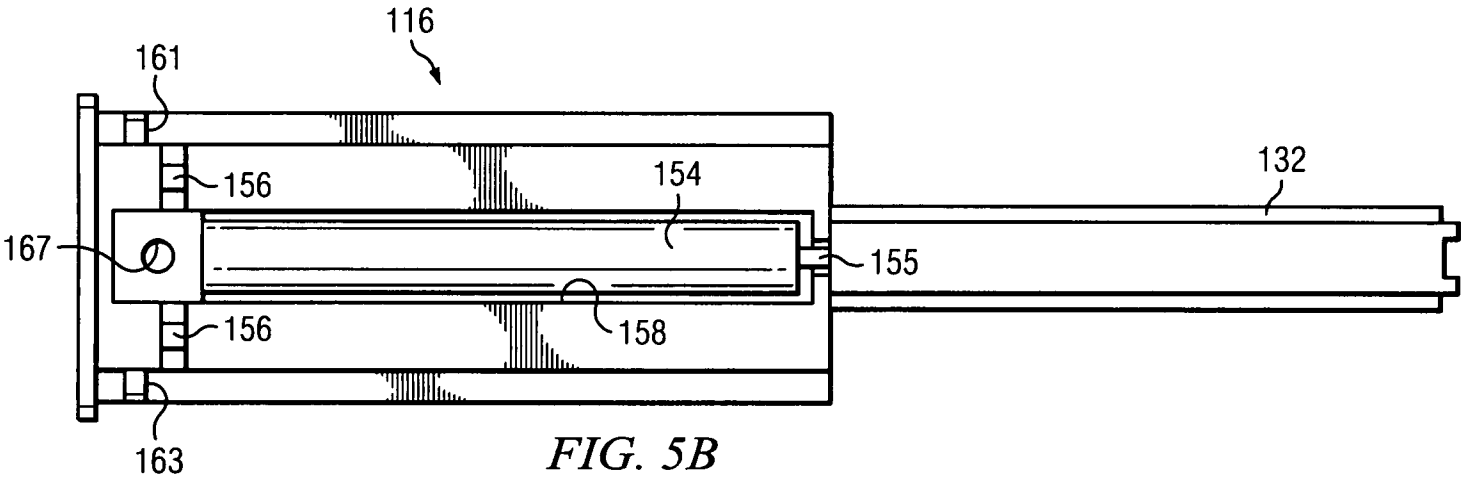
FIG. 5B is a plan view of the underside of a preferred embodiment of the fixture.
Figure 6A:
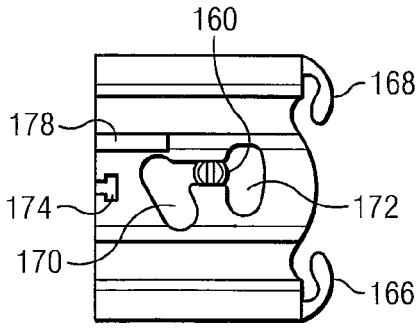
FIG. 6A is a plan view of a preferred embodiment of the carriage.
Figure 6B:
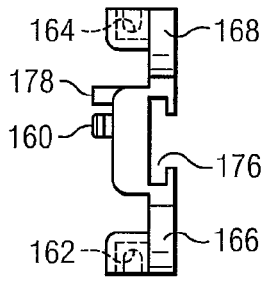
FIG. 6B is a side elevation view of a preferred embodiment of the carriage.
Figure 7A:
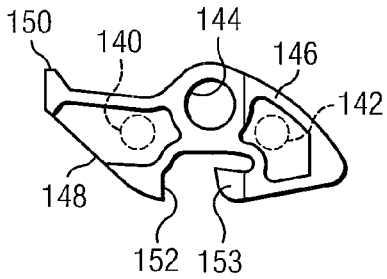
FIG. 7A is a plan view of a preferred embodiment of the pivotal latch.
Figure 7B:
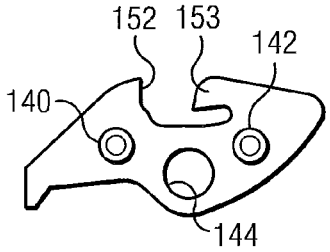
FIG. 7B is a plan view of the underside of a preferred embodiment of the pivotal latch.
Figure 7C:
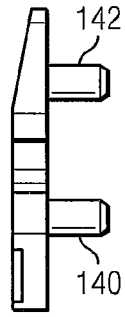
FIG. 7C is a side elevation view of a preferred embodiment of the pivotal latch.

Referring to FIGS. 1 and 2, drawer slide assembly 100 is comprised of fixed member 102, middle member 104, drawer member 106, and soft close mechanism 108. Fixed member 102 is mounted to the inside of the cabinet frame of a furniture piece having a drawer using common attachment hardware such as wood screws. Middle member 104 is slidingly engaged with fixed member 102 with a series of linear bearings including bearings 202 and retainer 203. Drawer member 106 is slidingly engaged with middle member 104 with a second series of linear bearings including bearings 204 in second retainer 205. Drawer member 106 is mounted to the side of the drawer frame of the cabinet piece using common attachment hardware such as wood screws through a plurality of mounting holes or a pair of tabs 182. Tabs 182 facilitate location of drawer member 106 on the side of the drawer frame while the mounting hardware attaches to the bottom of the drawer frame. Drawer member 106 further includes projection 186 for releasably engaging soft close mechanism 108. Soft close mechanism 108 is attached to fixed member 102 via a pair of tabs 156 (shown best in FIG. 5B) located on the underside of soft close mechanism 108. Tabs 156 engage pair of slots 184 located on fixed member 102. Projection 190 located on one end of the guide track of soft close mechanism 108 fits under clip 188 located on fixed member 102 to further secure soft close mechanism 108 to fixed member 102.

Referring to FIGS. 3A through 9B, soft close mechanism 108 is comprised of fixture 116 which supports carriage 118 and pivotal latch 120.

Fixture 116 is comprised of base 130 integrally formed with guide track 132. Guide track 132 extends longitudinally from base 130. Base 130 is generally rectangular. Slot 158 houses damper 154. Damper 154 includes piston rod 155. Base 130 includes hook 161 and hook 163 for attachment points to springs 112 and 114. Springs 112 and 114 fit adjacent retaining flanges 212 and 214, respectively. The axis of each spring is located equidistantly from longitudinal axis of guide track 132 and the longitudinal axis of piston rod 155. Guide track 132 includes a longitudinal channel 135 and a pair of opposing catches 134 and 136. Slot 158, damper 154, piston rod 155, and channel 135 are generally axially aligned.

Carriage 118 is generally square and includes guide track receiver 176. Guide track receiver 176 is axially aligned with channel 135 and is spaced equidistantly from each spring 112 and 114. Guide track receiver 176 slidingly engages guide track 132. Carriage 118 further comprises off-center column 160 flanked by two arcuate slots 170 and 172. Carriage 118 also includes hooks 162 and 164. Hooks 162 and 164 attach to springs 112 and 114. Bumpers 166 and 168 extend from carriage 118 and are arcuately shaped projections comprised of a resilient material. T-slot 174 accepts piston rod 155 and is fixed to annular indention 206. Adjacent arcuate slot 170 is stop 178. Stop 178 is a rectangular shaped projection extending from carriage 118.

Referring to FIGS. 7A through 9B, pivotal latch 120 is comprised of arms 146 and 148 separated by hole 144. Arm 148 includes projection 150, catch 152, and cylindrical post 140. Arm 146 includes locator spring 153 and cylindrical post 142. Locator spring 153 is an arcuately shaped projection comprised of a resilient material. Pivotal latch 120 is attached to carriage 118 by engagement of hole 144 with column 160. The diameter of hole 144 is slightly larger than the diameter of column 160 to provide for rotation of the pivotal latch with respect to the carriage. Column 160 is split and includes a lip on its upper edge to secure pivotal latch 120.

In use, a drawer slide assembly 100 is typically mounted on each side of a drawer. During a closing sequence, as shown by the direction arrow 250, each assembly engages the drawer and, in concert, draws it into a closed position with a balanced force. The assemblies hold the drawer in the closed position until sufficient force is applied to the drawer in an opening direction, as shown by arrow 260, to extend each assembly and disengage the drawer.

Figure 3A:
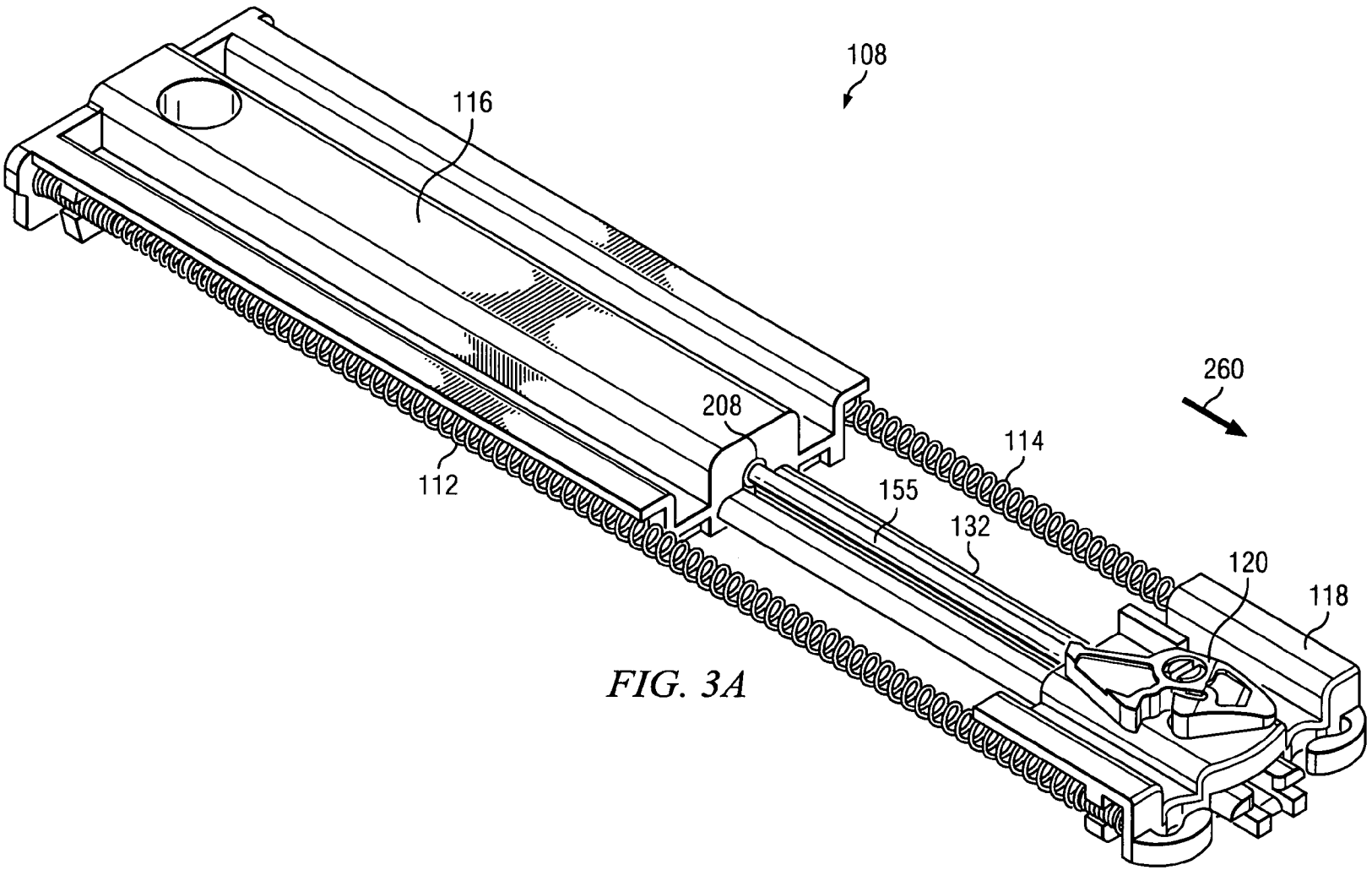
FIG. 3A is an isometric view of a preferred embodiment of the soft close mechanism in a disengaged position.

As shown in FIG. 3A, when the drawer is in the open position, drawer member 106 is disengaged from soft close mechanism 108. Springs 112 and 114 are elongated. Pivotal latch 120 has been rotated about column 160 in direction 192 into the position shown in FIGS. 8A and 9A. Carriage 118 is located at the end of guide track 132. Posts 140 and 142 of pivotal latch 120 are seated in catches 134 and 136 and resist the force exerted by the springs. Catches 134 and 136 are diametrically opposed. The position of the catches reduces the force necessary to rotate the pivotal latch upon initiating a closing sequence, thereby reducing wear on the components and facilitating ease of operations.

Upon initiating a closing sequence, a force in the closing direction shown by arrow 250 causes projection 186 on drawer member 106 to deflect locator spring 153, override it, and abut catch 152 of pivotal latch 120. Bumpers 166 and 168 abut middle member 104 to prevent damage. Pivotal latch 120 rotates in the direction as shown by arrow 194. Posts 140 and 142 move through arcuate slots 170 and 172 and out of catches 134 and 136 and become aligned in channel 135. Projection 150 and stop 178 prevent pivotal latch 120 from over rotating. Springs 112 and 114 contract, whereby carriage 118 moves toward end 138 of base 130.

Because of their equidistant space from the axially aligned damper 154, piston rod 155, channel 135, and guide track receiver 176, springs 112 and 114 exert a balanced force on carriage 118 creating no moment about the axis of the carriage perpendicular to the track. The location of the springs thereby greatly reduces the wear of the carriage riding on the track, the piston rod and the damper. Further, because of the balance of forces, the force necessary to engage and disengage projection 186 with pivotal latch 120 is lessened, thereby resulting in smoother, quieter and less noticeable engagement and drawer operation. Once projection 186 overrides locator spring 153, projection 186 engages catch 152 and pivotal latch 120 rotates. Carriage 118 begins to move toward end 138. During the closing sequence, projection 186 is securely engaged with pivotal latch 120. Before projection 186 engages catch 152 and pivotal latch 120 rotates, locator spring 153 prevents projection 186 from inadvertently backing out and releasing from pivotal latch 120 without sufficient force applied to drawer member 106 in the opening direction. Once projection 186 engages catch 152 and pivotal latch 120 rotates and springs 112 and 114 begin to contract pulling the drawer closed, damper 154 controls the rate at which drawer member 106 closes.

Figure 3B:
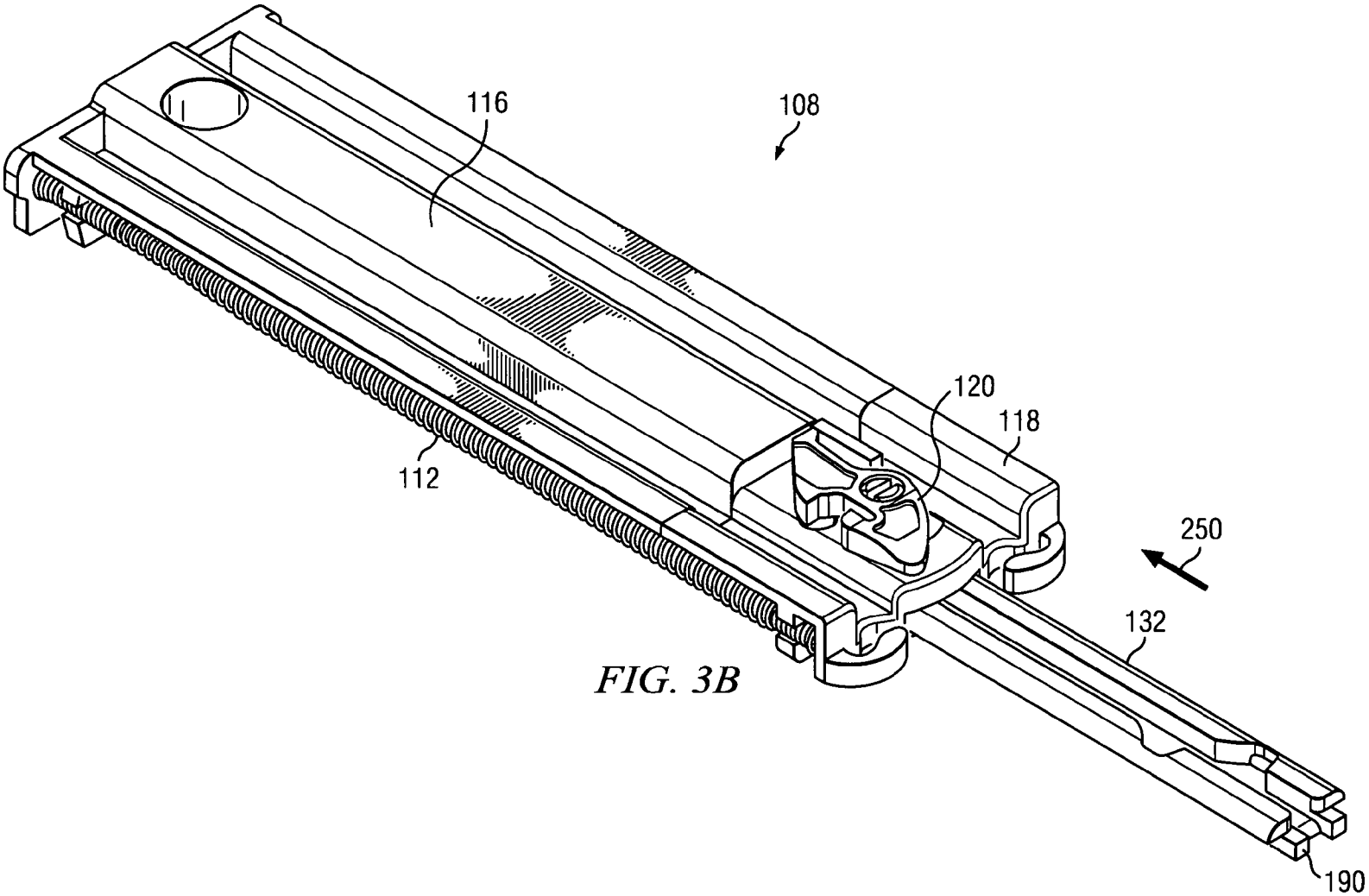
FIG. 3B is an isometric view of a preferred embodiment of the soft close mechanism in an engaged position.
Figure 4:
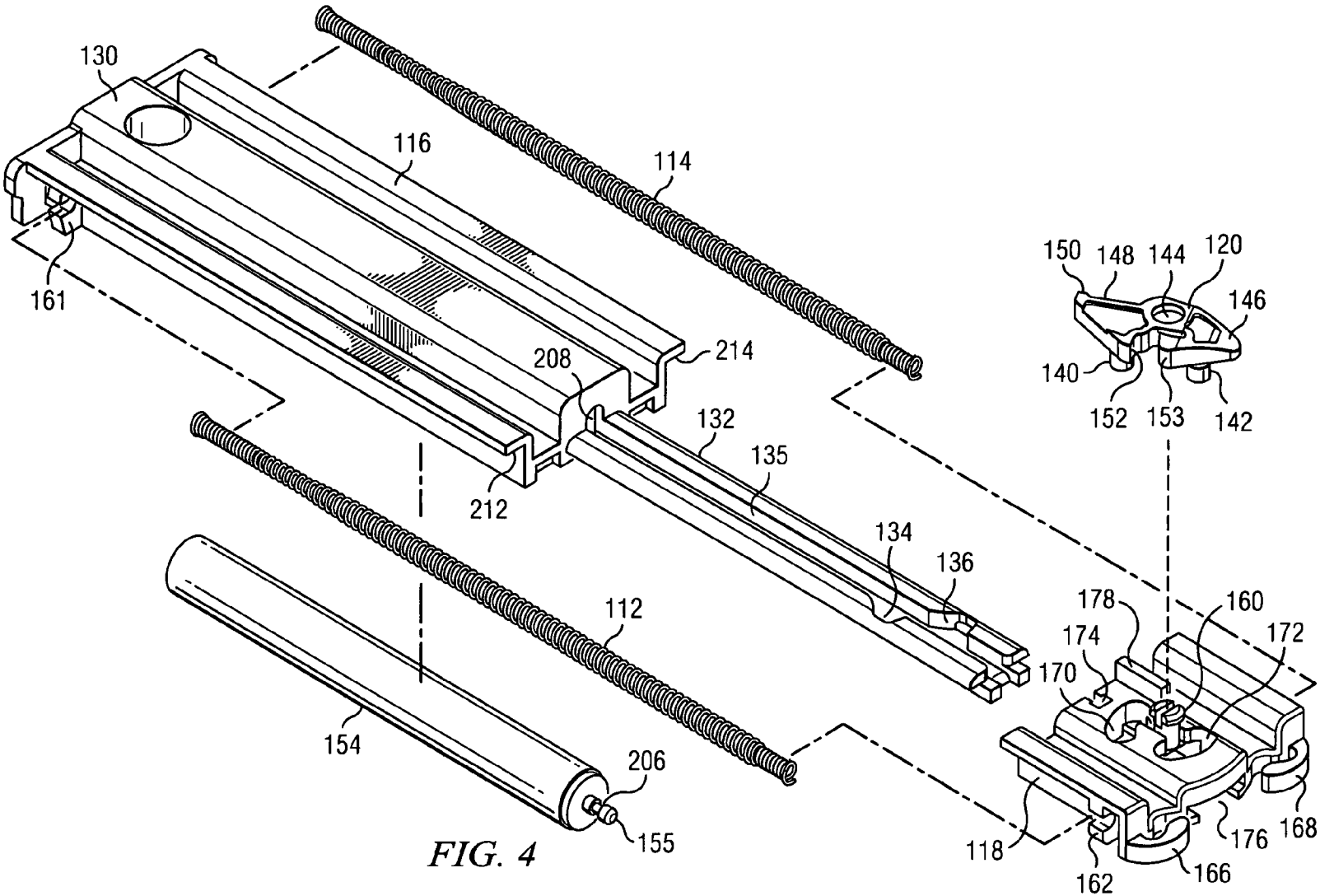
FIG. 4 is an exploded isometric view of a preferred embodiment.
Figure 8A:
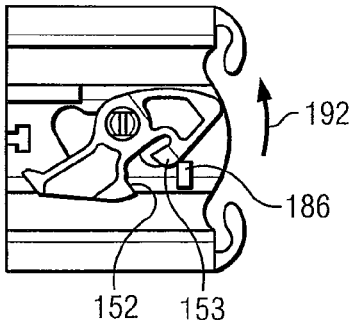
FIG. 8A is a plan view of a preferred embodiment of the pivotal latch attached to the carriage of the soft close mechanism in a disengaged position.
Figure 8B:
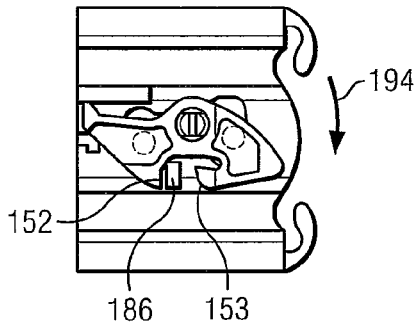
FIG. 8B is a plan view of a preferred embodiment of the pivotal latch attached to the carriage of the soft close mechanism in an engaged position.
Figure 9A:
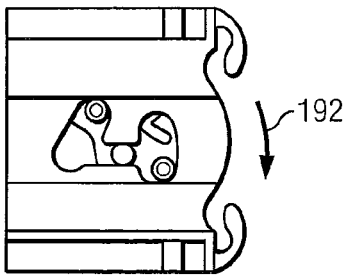
FIG. 9A is a plan view of the underside of a preferred embodiment of the pivotal latch attached to the carriage of the soft close mechanism in a disengaged position.
Figure 9B:
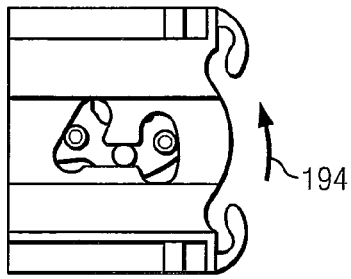
FIG. 9B is a plan view of the underside of a preferred embodiment of the pivotal latch attached to the carriage of the soft close mechanism in an engaged position.

As shown in FIGS. 3B, 8B and 9B, when the drawer is in a closed position, carriage 118 contacts end 138 of base 130. Posts 140 and 142 are aligned with channel 135. Projection 186 abuts catch 152 and is engaged with pivotal latch 120.

Upon initiating an opening sequence, a force in the opening direction shown by arrow 260 causes drawer member 106, still engaged with pivotal latch 120, to pull carriage 118 and pivotal latch 120 along guide track 132 away from base 130 until posts 140 and 142 move through arcuate slots 170 and 172 and engage catches 134 and 136. Pivotal latch 120 rotates in the direction as shown by arrow 192. Projection 186 deflects locator spring 153, overrides locator spring 153, and disengages from pivotal latch 120. Pivotal latch 120 is locked into the disengaged position. Drawer member 106 is thus disengaged from the assembly and is free to open to the extent provided by the rails.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

The invention claimed is:

1. A soft close mechanism attached to a drawer slide assembly for controlling the closing of a drawer in a piece of furniture, the soft close mechanism comprising;

a base having a first end and a second end;

the base including a first hook and a second hook proximate the first end and a slot housing a damper located between the first end and the second end and between the first hook and the second hook, wherein the damper further includes a piston rod;

a guide track integrally formed with the base extending from the second end wherein the guide track includes a longitudinal channel and a first catch and a second catch, where the slot, the piston rod, and the longitudinal channel are axially aligned;

a carriage connected to the piston rod and having a groove, axially aligned with the piston rod, for slidable engagement with the guide track;

the carriage further including a column flanked by a first arcuate slot and a second arcuate slot, a third hook, and a fourth hook;

a pivotal latch for releasable engagement with the drawer slide assembly having a first arm and a second arm separated by a hole for rotatable engagement with the column;

the first arm comprising a first post and a catch and the second arm comprising a second post and a locator spring wherein the first post and the second post are slidably engaged with the first arcuate slot and the second arcuate slot and the first catch and the second catch;

a first spring engaged with the first hook and the third hook; and a second spring engaged with the second hook and the fourth hook.

2. The soft close mechanism of claim 1 where the first spring and the second spring are spaced equidistant from the slot, the piston rod, and the longitudinal channel.

3. The soft close mechanism of claim 1 wherein the slot, the piston rod, and the longitudinal channel are axially aligned.

4. The soft close mechanism of claim 1 having an engaged position where the first post and the second post are linearly aligned with the longitudinal channel causing the first spring and the second spring to pull the carriage connected to the pivotal latch engaged with the drawer slide assembly along the guide track towards the second end of the base against the bias of the damper until the carriage contacts the base.

5. The soft close mechanism of claim 1 having a disengaged position where the first post and the second post are engaged with the first catch and the second catch causing the pivotal latch to rotate about the central axis of the column until the drawer slide assembly is released from engagement with the pivotal latch.

* * * * *